US005503629A

United States Patent [19]

Catone et al.

[11] Patent Number: 5,503,629

[45] Date of Patent: Apr. 2, 1996

[54] SYSTEM FOR ENHANCING NOURISHMENT OF A MAXILLOMANDIBULARLY FIXATED PATIENT

[76] Inventors: Guy A. Catone, 620 Amberson Ave., Pittsburgh, Pa. 15232; Fred Schmidt, 6742 Elkrush Dr., Imperial, Pa. 15126

[21] Appl. No.: 247,219

[22] Filed: May 20, 1994

[51] Int. Cl.[6] ..... A61J 7/00

[52] U.S. Cl. ..... 604/77

[58] Field of Search ..... 604/77, 79; 128/776, 128/859, 861; 606/234, 235, 236; 433/6, 70, 80, 229

[56] References Cited

U.S. PATENT DOCUMENTS

| | | | |
|---|---|---|---|
| 683,075 | 9/1921 | Schneider | 604/77 |
| 3,060,935 | 10/1962 | Riddell | 604/77 |
| 4,112,936 | 9/1978 | Blachly | 128/861 |
| 4,270,531 | 6/1981 | Blachly et al. | 128/861 |
| 4,664,109 | 5/1987 | Rasocha | 128/861 |
| 5,031,611 | 7/1991 | Moles | 433/6 |
| 5,104,315 | 4/1992 | McKinley | 433/80 |

OTHER PUBLICATIONS

N. L. Rowe and J. L. Williams (eds.), *Maxillofacial Injuries*, vol. 2, pp. 701, 702 and 708. Churchill Livingstone, London, 1985.

R. O. Dingman and P. Natvig, *Surgery of Facial Fractures*, Ch. 13, pp. 339–342, W. B. Saunders Company, Philadelphia, 1964.

W. H. Bell (ed.), *Modern Practice in Orthognathic and Reconstructive Surgery*, pp. 118–119, W. B. Saunders Company, Philadelphia, 1992.

R. J. Fonseca and R. V. Walker, *Oral and Maxillofacial Trauma*, vol. 1, pp. 74–87, W. B. Saunders Company, Philadelphia, 1991.

W. R. Proffit and R. P. White, Jr., *Surgical–Orthodontic Treatment*, pp. 233–234, C. J. Mosby Company, St. Louis, 1991.

D. M. Laskin, *Oral and Maxillofacial Surgery*, vol. 1, pp. 341–342, C. V. Mosby Company, St. Louis, 1980.

*Primary Examiner*—Corrine M. Maglione
*Assistant Examiner*—N. Kent Gring
*Attorney, Agent, or Firm*—Reed Smith Shaw & McClay

[57] ABSTRACT

A therapeutic implant apparatus adapted for installation in the mouth of a maxillomandibularly fixated patient to facilitate oral feeding of the patient. The apparatus is installed in the patient's mouth and where it remains throughout the fixation therapy. The apparatus comprises an arched member having a tubular conduit provided therein. The tubular conduit includes an inlet port adapted for connection to a feeding tube and at least one outlet port for discharging liquid conveyed by the feeding tube into the patient's mouth. The arched member is preferably U-shaped in configuration to correspond substantially to the arrangement of the patient's dentition and is desirably fabricated from flexible material to accommodate the topography of the patient's teeth.

9 Claims, 6 Drawing Sheets

SYSTEM FOR ENHANCING NOURISHMENT OF A MAXILLOMANDIBULARLY FIXATED PATIENT

FIELD OF THE INVENTION

The present invention relates in general to systems for nourishing individuals having occluded oral passageways and, more particularly, to apparatus and methods for enhancing nourishment of patients experiencing maxillomandibular fixation.

BACKGROUND OF THE INVENTION

The treatment of the reconstructive, deformity or trauma patient who has undergone maxillofacial surgery frequently requires postoperative intermaxillary (maxillomandibular) fixation wherein the upper and lower jaws are commonly wired together using braces-like arch bars applied to the natural teeth. A drawback to maxillomandibular fixation, however, is that the patient's oral passageway typically becomes effectively occluded. Occlusion occurs because of the interfering positions of the teeth which results from fixing the position of the lower jaw relative to the upper jaw. Usually there is sufficient space between the teeth and in the retromolar region to enable the patient to orally consume liquid nutrients through a tube or straw either by means of mildly pressurized introduction (e.g., via syringe) or by virtue of the patient's own suction. Nevertheless, this method of feeding has long been recognized as deficient in maintaining adequate or, more importantly, optimal nutrition which is essential for proper healing. Indeed, maxillomandibularly fixated patients commonly encounter fatigue, frustration or pain while attempting to satisfy their appetites using conventional tube or straw feeding techniques. Patient compliance with the feeding therapy is thereby hindered. Consequently, most patients experience at least moderate weight loss and/or nutrient deficiencies during the fixation period despite increasing the number and frequency of prescribed feedings.

Publications pertaining to nourishment of intermaxillary or maxillomandibular fixation patients include the following:

1. N. L. Rowe and J. L. Williams (eds.), *Maxillofacial Injuries,* Vol. 2, pp. 701, 702 and 708. Churchill Livingstone, London, 1985.

2. R. O. Dingman and P. Natvig, *Surgery of Facial Fractures,* Ch. 13, pp. 339–342, W. B. Saunders Company, Philadelphia, 1964.

3. W. H. Bell (ed.), *Modern Practice in Orthognathic and Reconstructive Surgery*, pp. 118–119, W. B. Saunders Company, Philadelphia, 1992.

4. R. J. Fonseca and R. V. Walker, *Oral and Maxillofacial* Trauma, Vol. 1, pp. 74–87, W. B. Saunders Company, Philadelphia, 1991.

5. W. R. Proflit and R. P. White, Jr., *Surgical-Orthodontic Treatment,* pp. 233–234, C. J. Mosby Company, St. Louis, 1991.

6. D. M. Laskin, *Oral and Maxillofacial Surgery,* Vol. 1, pp. 341–342, C. V. Mosby Company, St. Louis, 1980.

An advantage exists, therefore, for a system including apparatus and methods for facilitating nourishment of maxillomandibularly fixated patients. The apparatus of such a system should be uncomplicated in design, manufacture, installation and operation. It should also be comfortable to the patient to wear as well as capable of conveying quantities of liquids and liquefied nutrients sufficient to simultaneously provide ample nutrition and hunger satisfaction with each feeding. Hence, patient compliance with the feeding therapy may be increased while the number of daily feedings may be proportionately reduced.

SUMMARY OF THE INVENTION

The present invention proposes a system for enhancing nourishment of patients who experience maxillomandibular fixation treatment as a result of trauma damage or, for example, orthognathic surgery such as reconstructive surgery or surgery to correct a deformity. The system includes methods and apparatus for enhancing delivery of liquids and liquefied nutrients to a patient's oral passageway which is substantially occluded by the teeth because of the fixation of the lower jaw to the upper jaw.

According to all presently preferred embodiments, the apparatus is a temporary therapeutic implant comprising an arched, preferably U-shaped, member including a tubular conduit having an inlet port and at least one outlet port. The apparatus is desirably formed of flexible material such that the conduit may be adapted to generally conform in three dimensions to the dentitional arrangement and topology unique to each patient. The inlet port is preferably located at the crest of the arched member and faces radially outwardly therefrom, whereas the at least one outlet port faces radially inwardly.

Prior to execution of maxillomandibular fixation, the apparatus is positioned by the surgeon such that the crest of the arched member is situated between and in alignment with the patient's front teeth while the legs of the member extend generally along and between the patient's upper and lower lateral teeth. The inlet port is then centered as nearly as possible between the centralmost of the patient's incisors, the lower jaw is pivoted so as to gently grip the apparatus between the upper and lower teeth, and the relative positions of the jaws are fixed according to any suitable surgical technique. The apparatus thus remains in the patient's mouth as a temporary implant throughout the fixation period.

When properly installed, the inlet port faces outwardly from the incisors and is oriented to releasably receive an end of a feeding tube while the one or more outlet ports face radially inwardly toward the patient's tongue. The inlet port may act as a male or a female connector for the feeding tube. That is to say, the inlet port may be provided with a relatively short tubular intake duct about which the feeding tube end is frictionally connectable; alternatively, the inlet port may be provided with a chamfered funnel-like opening into which the end of the feeding tube may be inserted and frictionally received. If the inlet port includes an intake duct, such duct should be of no greater than about one-fourth inch in length in order to minimize lip contact pressure and abrasion that may result in ulcerous erosion, scarring or deformity of the lips. Likewise, the outlet port(s) may be fitted with short hollow discharge ducts, but these too must be no more than a few millimeters in length to avoid bothersome and possible harmful contact with the tongue.

Other presently preferred embodiments of the apparatus include prefabricated incorporation of the tubular conduit into a generally U-shaped plate member either by embedment of the tubular conduit in a curable plastic or by formation of the geometry of the tubular conduit into a molded plastic article.

It is further contemplated that the apparatus may be placed into a mass of self-curing acrylic polymer during surgical repair of the patient's facial skeleton. In this way, the stability of the apparatus within the mouth is augmented during and after surgery and, upon curing of the polymer, the outlet or discharge ports may be easily opened by removing the excess polymer from the portals with a burr or similar implement.

As mentioned above, the intake port is adapted to be releasably connected to a feeding tube, the opposite end of which may be connected to a source of liquid or liquefied nutrients. The nutrient source may be unpressurized whereby the patient may use his own suction to draw the nutrients into his mouth, or it may be mildly pressurized (as by the piston force created by a syringe) to assist conveyance of the nutrients through the feeding tube. In either case, the nutrients enter the patient's mouth through the outlet port(s) in one or more gentle, steady streams. The patient may thus more comfortably consume greater quantities of nutrients than was heretofore possible by use of the relatively crude feeding techniques previously employed in the art. Consequently, nourishment and healing are materially improved while discomfort and nuisance attendant to oral tube feeding is correspondingly abated.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
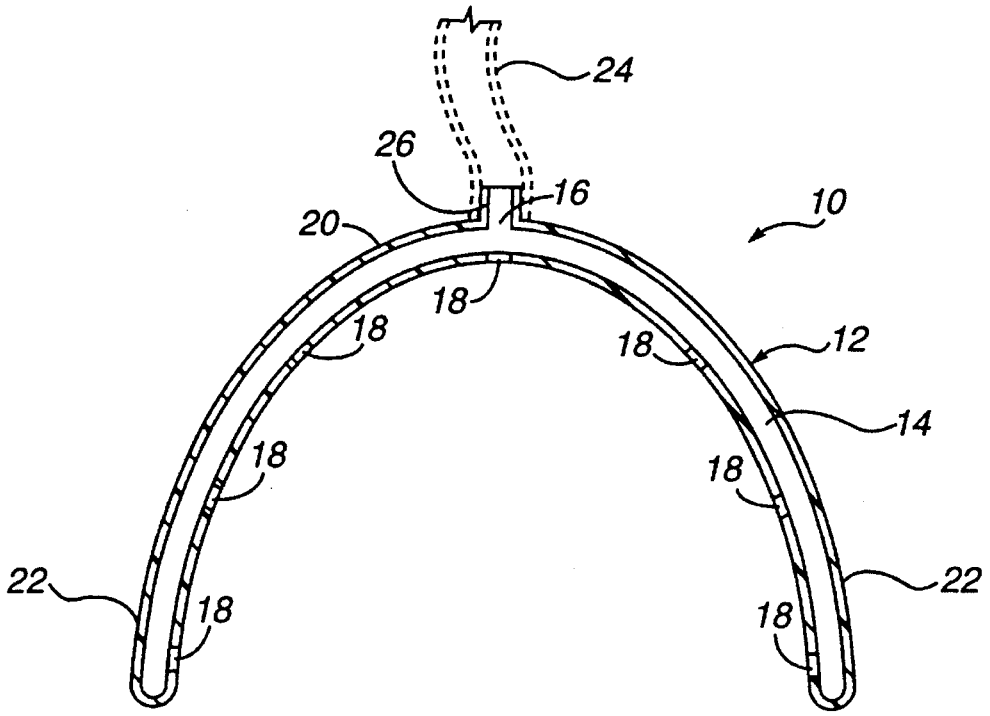
FIG. 1 is a plan view, in cross-section, of a first preferred embodiment of an apparatus constructed in accordance with the present intention.

Referring to FIG. 1, there is illustrated a first presently preferred embodiment of the apparatus according to the instant invention, herein designated by reference numeral 10. Apparatus 10, as are all later-described embodiments of the invention, a temporary therapeutic implant which is installed in a patient's mouth during maxillomandibular fixation surgery and which remains in the patient's mouth throughout the postoperative convalescent period. Upon sufficient healing, the jaw fixation instrumentality and the apparatus 10 are removed. During fixation treatment, apparatus 10 (or one of the alternative embodiments thereof described infra) functions to facilitate delivery of liquid or liquefied nutrients to the patient's oral passageway, thereby promoting optimal nourishment and healing with reduced disturbance to the patient.

As is common to all presently preferred embodiments of the invention, apparatus 10 desirably comprises an arched, generally U-shaped member 12 corresponding substantially in shape to the arrangement of a patient's dentition. According to FIG. 1, this member includes a tubular conduit 14 having at least one inlet port 16 and at least one outlet port 18. The apparatus is preferably fabricated from flexible material including malleable metals, metal alloys or flexible plastics. If formed of metallic materials, the apparatus should be coated with a thin layer of insulative (e.g., plastic) material to prevent possible galvanic current flow between the apparatus and the patient's metallic dental fillings (if any are present). Most preferably, however, apparatus 10 and all alternatives thereto are formed of flexible plastic including, but not limited to, polypropylene, polethylene and vinyl compounds. So constructed, the apparatus may readily conform itself in three dimensions to the topology unique to each patient's dentition. Moreover, the shell of the apparatus should be at least mildly resistant to compression in order to prevent collapse of the tubular conduit 14, although this scenario is unlikely since the patient's lower jaw is effectively immobilized during fixation treatment. Tubular conduit 14 is preferably circular in cross-section and between about 3 to 5 millimeters in diameter.

As mentioned above, the configuration of the apparatus is preferably U-shaped or arched in shape, thereby defining a crest 20 and legs 22 generally conforming to the substantially U-shaped arrangement of the patient's teeth. It will be understood that the apparatus 10 and all later described versions of the invention may be manufactured in any size suitable to accommodate the mouths of the smallest infants to largest adults. Moreover, the apparatus may taper slightly from the crest 20 to the tips of the legs 22 for additional patient comfort.

Inlet port 16 is desirably located at the crest 20 and faces radially outwardly of the apparatus, whereas at least one outlet port 18 faces radially inwardly therefrom. Alternatively, one or more inlet ports 16 may be positioned along one or both of the legs 22 whereby the inlet port(s) may be somewhat enlarged relative to an inlet port or ports situated along crest 20. This is because posterior to the most distal molars there exists considerable space between the upper and lower jaws when the lower jaw is pivoted into a generally "closed" position. The trauma which gives rise to the fixation surgery and/or the surgery itself commonly results in swollen tissue which tends to close this space. By virtue of the present invention, however, the body of apparatus 10 can effectively maintain separation of the swollen tissue in the post-molar regions of the patient's mouth whereby substantial flow can be introduced at these locations.

During surgery, and prior to execution of maxillomandibular fixation, the apparatus is positioned by the surgeon such that the central curvature or crest 20 of the apparatus is situated between and in generally parallel alignment with the curvature established by the arrangement of the patient's front teeth while the legs 22 extend generally along and between the patient's upper and lower lateral teeth. The inlet port is then centered as nearly as possible between the centralmost of the patient's incisors, the lower jaw is pivoted so as to gently grip the member 12 between the upper and lower teeth, and the relative positions of the jaws are fixed according to any suitable surgical technique. The apparatus 18 thus remains in the patient's mouth as a temporary implant for the duration of the implant period.

Once the apparatus is installed, the inlet port 16 faces outwardly form the patient's incisors and is oriented to releasably receive an end of a flexible feeding tube 24 (shown in phantom line in FIG. 1) while the one or more outlet ports 18 face radially inwardly toward the patient's tongue. The inlet port 16 may act as a male connector (FIGS. 1, 2, 4, 7 and 10) or as a female connector (FIGS. 3, 5, 6, 8, 9 and 11) for the feeding tube 24.

In this regard, when serving as a male connector the inlet port 16 such as is shown in FIG. 1 may be provided with a relatively short tubular intake duct 26 about which the feeding tube is frictionally and releasably connectable. The intake duct should be of no greater length than about one-fourth inch to minimize lip contact pressure and abrasion that could lead to ulcerous erosion, scarring or deformity of the lips. The opposite end of the feeding tube 24 may be attached to a source of liquid or liquefied nutrients (not illustrated). The nutrient source may be unpressurized whereby the patient may use his own suction to draw the nutrients into his mouth. Alternatively, the nutrients in the feeding tube may be mildly pressurized (as, for example, by the piston force created by a syringe) to assist delivery of the nutrients through the feeding tube. Indeed, the feeding tube 24 as shown in FIG. 1 may comprise a secondary tube such as a standard short "extender" tube that is part of most conventional intravenous sets. The distal end of this secondary tube could also be provided with a "Luerloc" connector adapted for releasable attachment to a large bore 60 ml. or similar syringe for injecting the nutrients into the patient's mouth, as well as for rinsing the apparatus 10 and the patient's mouth following feeding.

Figure 2:
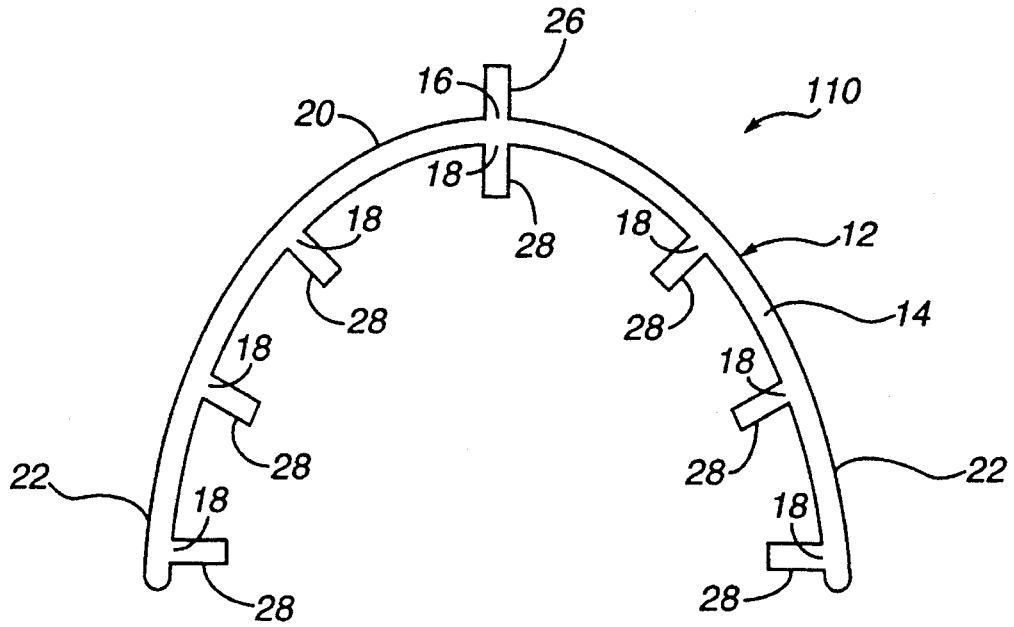
FIG. 2 is a plan view of a further preferred embodiment of the apparatus of the present intention.

FIG. 2 represents a further presently preferred embodiment of an apparatus constructed according to the instant invention, identified by reference numeral 110. Like reference numerals indicate similar elements possessing similar functions to those described in connection with FIG. 1. This is also the case in the remaining views. Thus, in FIG. 2 and subsequent views, only those elements of the apparatus which materially depart in structure and/or function from those of FIG. 1 or whose description is otherwise required for a proper understanding of the invention will be described in detail. Likewise, apparatus 110 may be surgically installed in the same or similar manner as apparatus 10 (as may all embodiments of the apparatus described hereafter).

Apparatus 110 is constructed substantially similar to apparatus 10 except that the outlet ports 16 are fitted with short hollow discharge ducts 28 configured generally like intake duct 26. Discharge ducts 26 must be no more than a few millimeters in length to avoid bothersome and possibly harmful contact with the patient's tongue.

Figure 3:
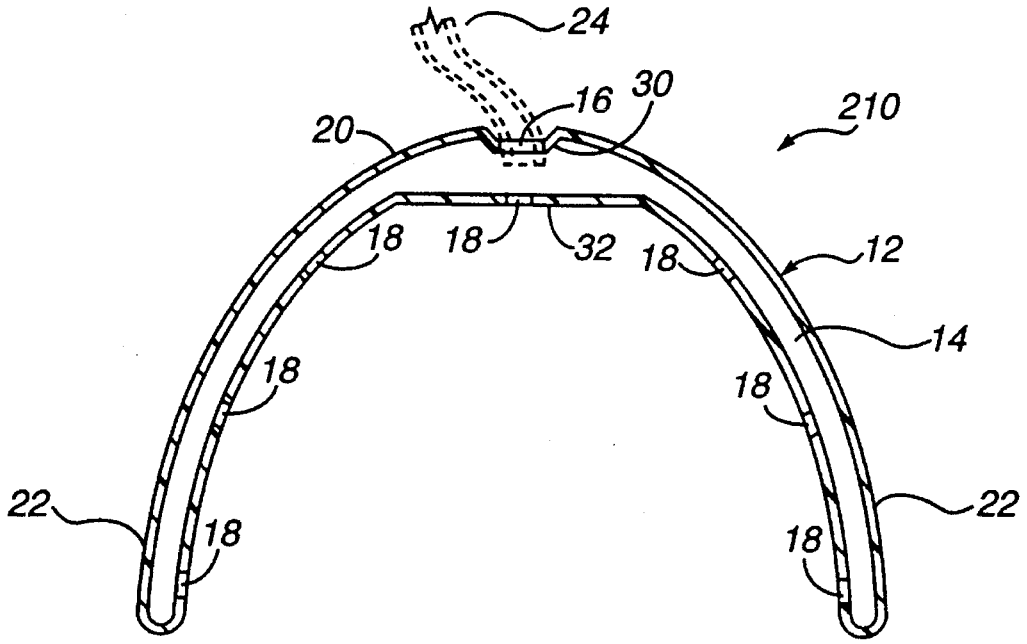
FIG. 3 is a plan view, in cross-section, of a further preferred embodiment of the apparatus of the present invention.

FIG. 3 shows an apparatus 210 also constructed substantially similarly to apparatus 10. In apparatus 210, however, the inlet port 16 is a female connector for the feeding tube 24. More specifically, the crest 20 of the member 12 is formed with a chamfered funnel-like opening 30 in advance of and contiguous with the inlet port 16. Constructed as such, the opening 30 guides the insertion of the feeding tube into the inlet port 16, which port is dimensioned to frictionally yet releasably receive the feeding tube. Further, to facilitate fluid communication and to accommodate the reduction in volume of the tubular conduit arising from the provision of the chamfered opening 30, it is preferred that the posterior tubular conduit wall at the crest of the conduit be slightly displaced from the inlet port 16, as is reflected by reference numeral 32. Such displacement should, however, be no more than about 5 millimeters to assure that the apparatus does not unduly interfere with movement of the patient's tongue.

Figure 4:
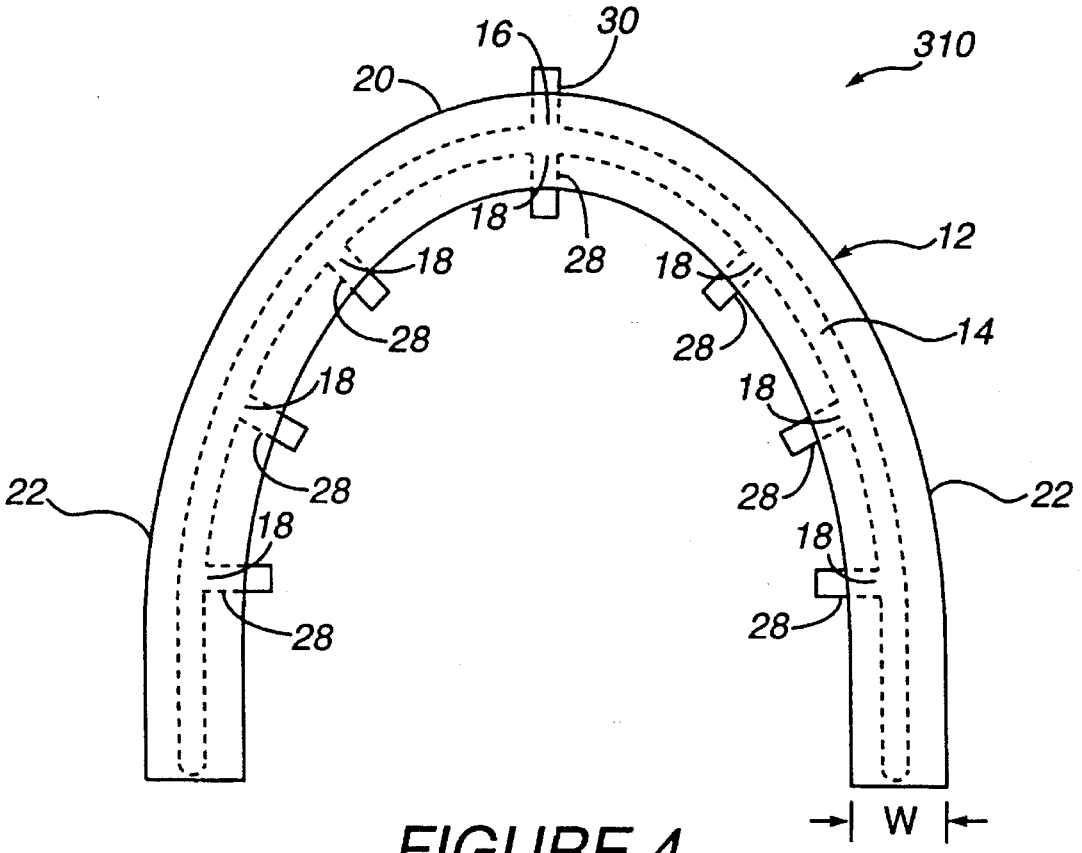
FIG. 4 is a plan view of a further preferred embodiment of the apparatus of the present invention.

FIG. 4 reveals a further embodiment of the invention identified as apparatus 310. Apparatus 310 represents a version of the invention wherein the member 12 is constructed as a generally U-shaped plate desirably formed of flexible plastic material such as, for example, polypropylene, polyethylene, or the like. As will be appreciated, the U-shaped plate member 12 may be appropriately sized and selected to correspond substantially to the U-shaped arrangement of virtually any patient's dentition. Likewise, the thickness of the plate member should not exceed about 5 millimeters so as to avoid patient discomfort upon installation. It is contemplated that apparatus 310 may be formed by prefabricating a distinct member including tubular conduit 14 and then embedding that member into the plate member 12 through suitable molding processes. Alternatively, the geometry of the tubular conduit 14, inlet port 16 and outlet conduit port(s) 18, may be formed directly into opposed U-shaped molded plate elements that may then be bonded face-to-face using known bonding techniques. Further, the width "W" of the plate member 12 should be no greater than about 10 millimeters to minimize bulk and potential contact with the patient's lips, cheeks, and tongue.

Figure 5:
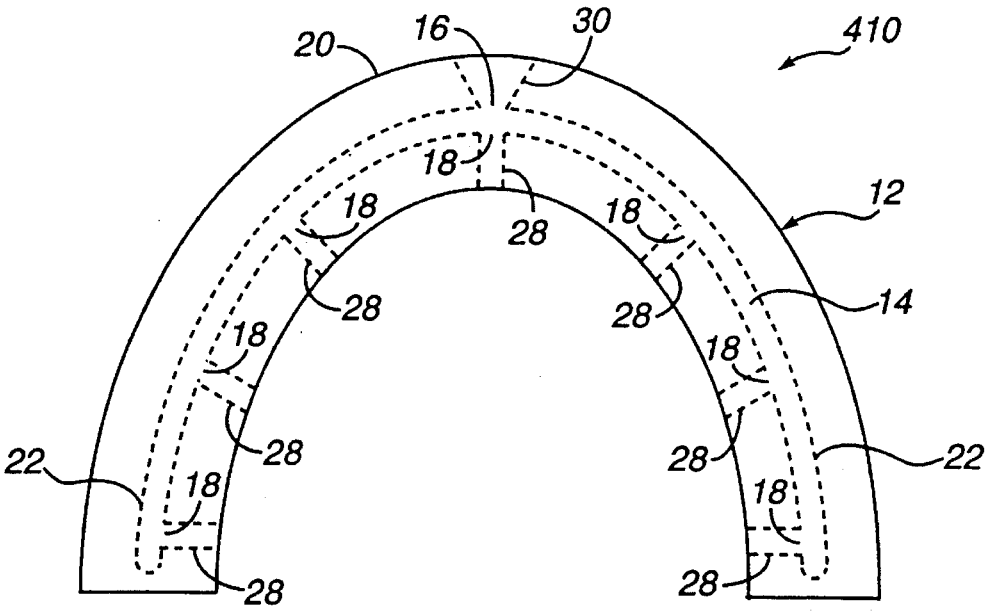
FIG. 5 is a plan view of a further preferred embodiment of the apparatus of the present invention.
Figure 6:
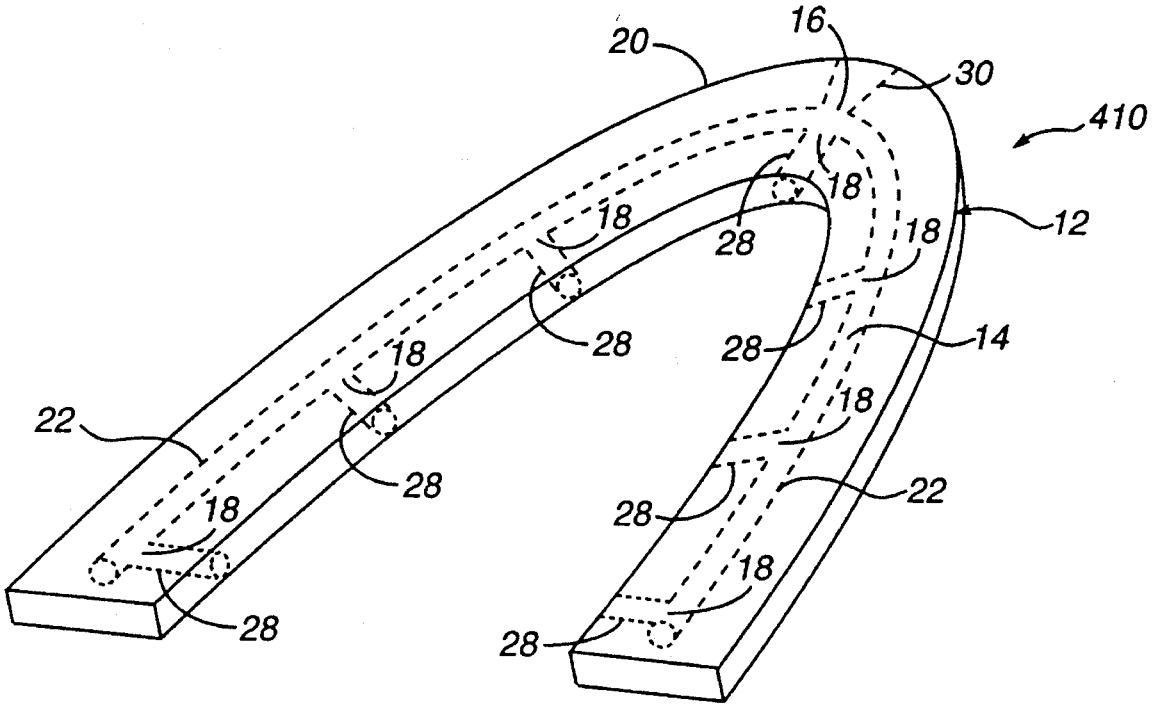
FIG. 6 is a perspective view of the apparatus depicted in FIG. 5.

A further presently preferred embodiment of the invention is illustrated in FIGS. 5 and 6. Like apparatus 310, the apparatus of FIGS. 5 and 6, designated by reference number 410, also incorporates the tubular conduit 14 into a generally U-shaped plate member 12. Dimensions, materials and fabrication techniques of apparatus 410 are generally consistent with those described in connection with apparatus 310. According to this particular embodiment, however, the inlet opening 16 is formed as a female connector for the unillustrated feeding tube in a manner similar to that represented by apparatus 210 of FIG. 2. That is, the plate member 12 is provided with a chamfered, funnel-like inlet opening 30 contiguous with inlet port 16.

Figure 7:
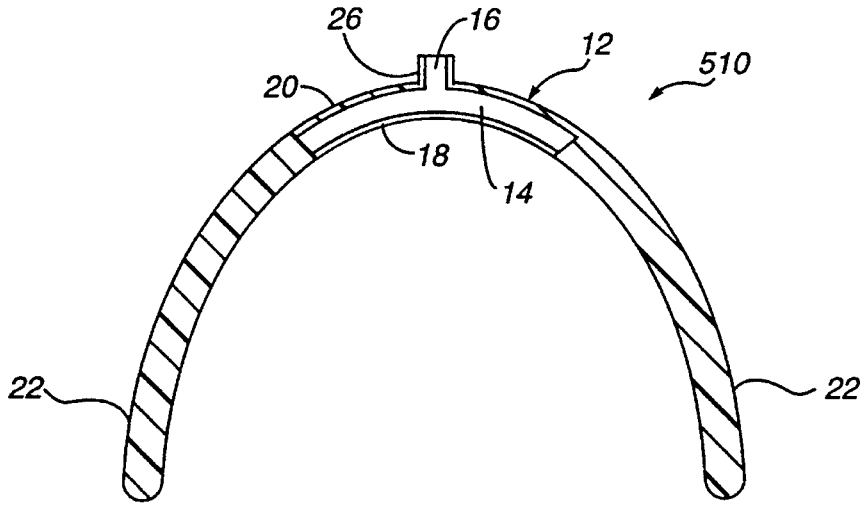
FIG. 7 is a plan view, in cross section, of a further preferred embodiment of the apparatus of the present invention.

FIG. 7 reflects a further embodiment of the present invention wherein the subject apparatus is identified by reference numeral 510. According to this embodiment, apparatus 510 is again generally U-shaped in configuration, although the tubular conduit 14 is confined primarily to the region of the crest 20. In addition, there is but a single outlet port 18 of elongated slit-like configuration extending for essentially the entire length of the tubular conduit. Alternatively, there may be no outlet port located adjacent the crest, but there may be a similar elongated outlet port located in one or both legs 22 (with the tubular conduit 14 being sufficiently extended along the length of either leg to communicate with such outlet port(s)).

Figure 8:
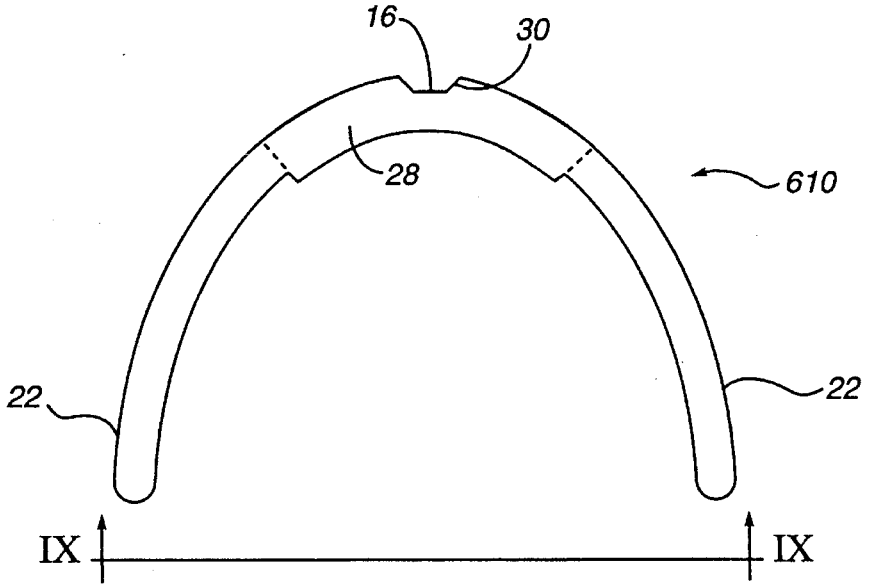
FIG. 8 is a plan view of a further preferred embodiment of the apparatus of the present invention.
Figure 9:
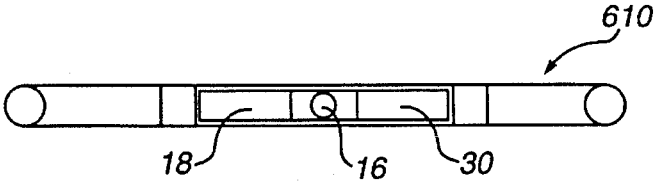
FIG. 9 is a view taken along line IX—IX of FIG. 8.

A further presently preferred embodiment of the invention is depicted in FIGS. 8 and 9. The apparatus therein, identified by reference numeral 610 is similar to apparatus 510 except that it includes a "female" type inlet port and an elongated discharge duct 28 surrounding the outlet port 18.

Figure 10:
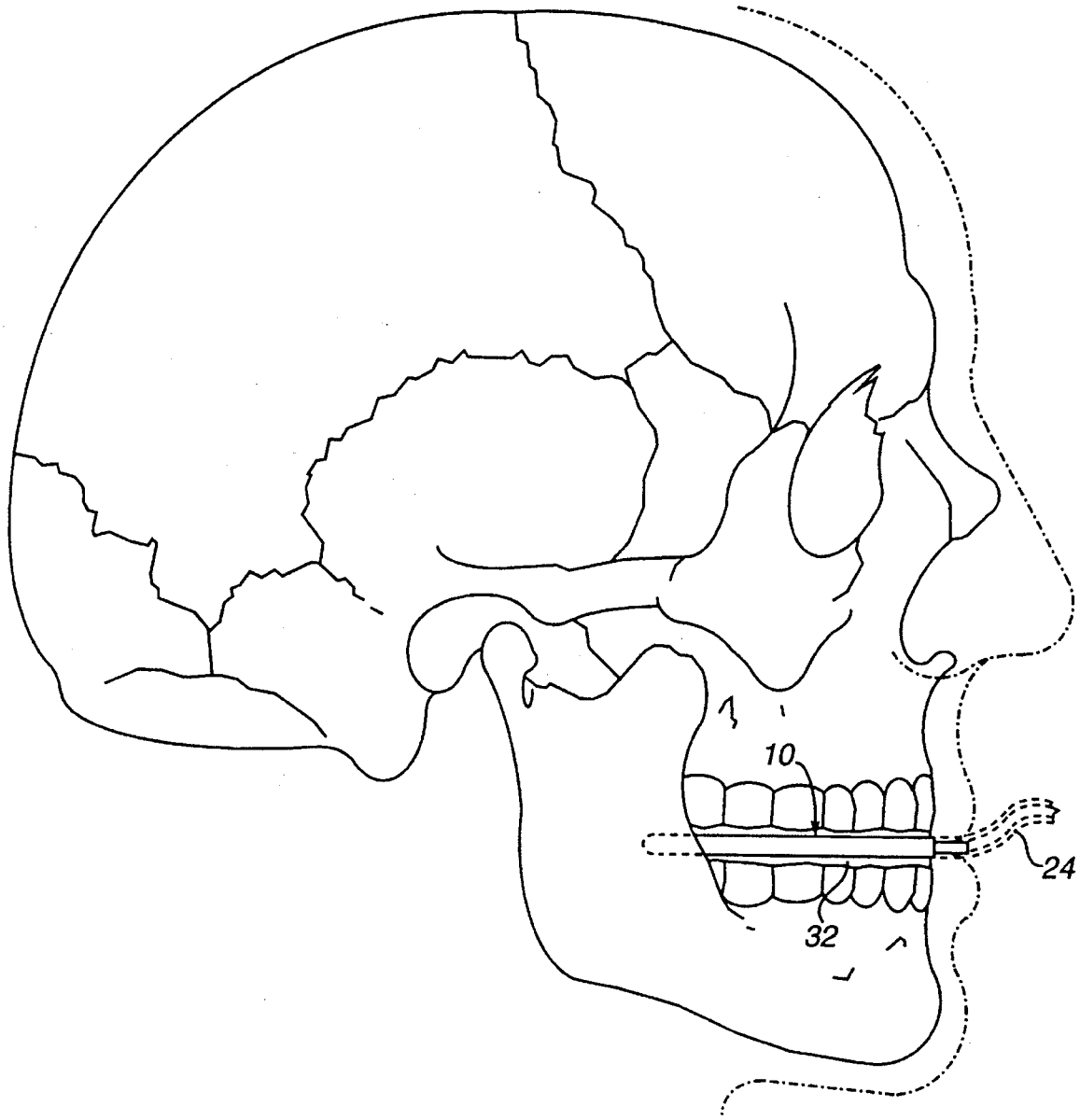
FIG. 10 is a side elevation view of one version of the apparatus of the present invention as operatively installed in a patient's mouth with the maxillomandibular fixation apparatus being omitted for clarity of illustration.

FIG. 10 depicts one embodiment of the invention, e.g., apparatus 10 with, a "male" inlet port, as it would appear in side elevation view when installed in a patient's mouth and when connected to a feeding tube 24 (with the maxillomandibular fixation apparatus omitted for clarity of illustration).

Figure 11:
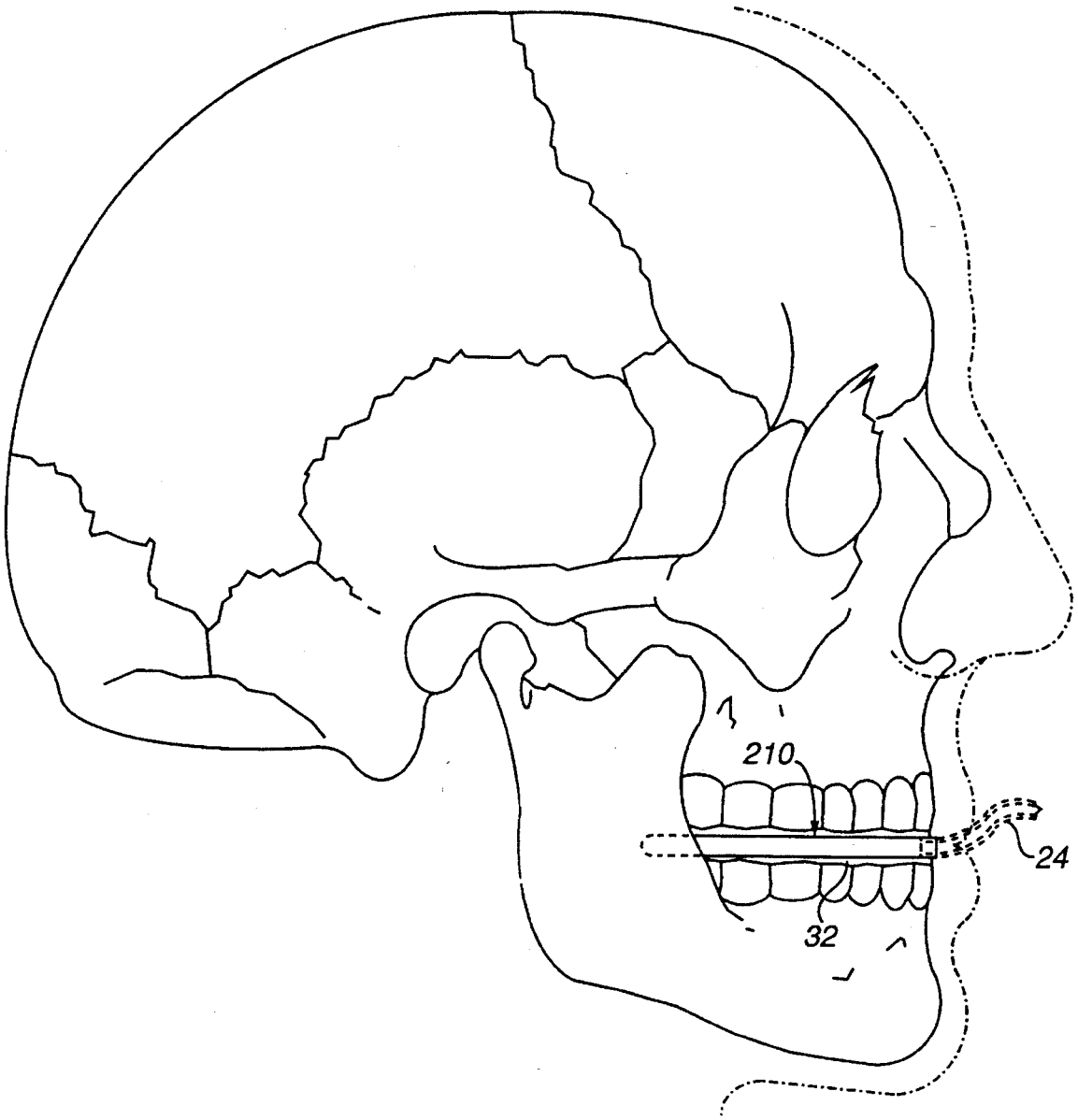
FIG. 11 is a view similar to FIG. 9 of another version of the apparatus of the present invention as operatively installed in a patient's mouth.

FIG. 11 is similar to FIG. 10 depicting another embodiment of the invention, e.g., apparatus 210 of FIG. 3 having a "female" inlet port, installed in a patient's mouth. Also shown in FIGS. 10 and 11 is a mass of self-curing adhesive polymer 32 which is typically used during surgical repair of the patient's facial skeleton to assist in stabilization thereof during the surgical procedure and postoperative recovery period. Such polymer is also useful in stabilization of the position of the apparatus according to the present invention. Further, upon curing of the polymer, the outlet ports and/or discharge ducts of the apparatus may be easily opened by pressurized fluid should they become occluded with excess polymer.

Although not exhaustively illustrated to exhibit all of its possible manifestations, it is further contemplated that within the scope of the present invention it is possible to form any embodiment of the apparatus as an arched member having substantially less than a U-shaped configuration, e.g., a length corresponding to any desired fraction of the crest 20 or of the crest and one or both of the legs 22. Moreover, the apparatus may include any combination of generally circular and/or elongated outlet ports and discharge ducts. Also, the inlet port need not be centered at the arch crest but may be displaced therefrom if the patient's oral condition requires such placement.

Although the invention has been described in detail for the purpose of illustration, it is to be understood that such detail is solely for that purpose and that variations can be made therein by those skilled in the art without departing from the spirit and scope of the invention and except as it may be limited by the claims.

1. A therapeutic implant apparatus adapted for installation in the mouth of a maxillomandibularly fixated patient to facilitate oral feeding of said patient, said apparatus comprising:

an arched member corresponding substantially in shape to a dentitional arrangement of said patient and defining an outer configuration adapted for disposition between upper and lower teeth of said patient, said outer configuration being formed so as to be free from projections extending toward said upper and lower teeth, said arched member comprising a generally U-shaped plate member including a crest and a pair of opposed legs extending from said crest, a tubular conduit corresponding substantially in shape to the shape of said arched member and lying within said arched member, said tubular conduit including at least one inlet port means located along said crest and facing radially outwardly therefrom for connecting said tubular conduit to means for conveying liquid and at least one outlet port means located along at least one of said crest and said legs and facing radially inwardly therefrom for discharging liquid conveyed by said liquid conveying means into the mouth of said patient, wherein said apparatus is fabricated from flexible material.

2. The apparatus of claim 1 wherein said flexible material is flexible plastic.

3. The apparatus of claim 1 wherein said at least one outlet port means comprises an elongated opening.

4. The apparatus of claim 1 wherein said at least one inlet port means include an intake duct adapted for insertion into said liquid conveying means.

5. The apparatus of claim 1 wherein said at least one outlet port means include at least one discharge duct.

6. The apparatus of claim 1 wherein said at least one outlet port means comprise a plurality of outlet ports.

7. The apparatus of claim 1 wherein said at least one inlet port means include a chamfered opening formed in said crest of said U-shaped plate member into which said liquid conveying means is adapted to be inserted.

8. A method for facilitating oral feeding of a maxillomandibularly fixated patient, said method comprising the steps of:

(a) selecting an arched member corresponding substantially in shape to a dentitional arrangement of said patient, said arched member including a tubular conduit, said tubular conduit including at least one inlet port means for connecting said tubular conduit means to means for conveying liquid and at least one outlet port means for discharging liquid conveyed by said liquid conveying means into the mouth of said patient;

(b) installing said arched member into the mouth of said patient such that said arched member positionally corresponds to a dentitional arrangement of said patient, wherein said at least one inlet port means face outwardly of said patient's mouth and said at least one outlet port means face inwardly of said patient's mouth;

(c) surgically affixing the lower jaw of said patient to the upper jaw of said patient to effect maxillomandibular fixation;

(d) connecting said at least one inlet port means to a means for conveying liquid; and (e) delivering liquid through said liquid conveying means whereby said liquid passes into said at least one inlet port means and said tubular conduit and is discharged into said patient's mouth.

9. The method of claim 8 further comprising, prior to step (b), the step of providing a self-curing polymer in said patient's mouth to assist in stabilization of the position of said arched member in said patient's mouth during step (c) and throughout said maxillomandibular fixation.

* * * * *